US005841406A

United States Patent [19]

Smith

[11] Patent Number: 5,841,406

[45] Date of Patent: Nov. 24, 1998

[54] CRITICALLY COUPLED BI-PERIODIC DRIVER ANTENNA

[76] Inventor: Sidney C. Smith, 5638 W. Alice Ave., Glendale, Ariz. 85302

[21] Appl. No.: 697,033

[22] Filed: Aug. 19, 1996

[51] Int. Cl.[6] ..... H01Q 21/12

[52] U.S. Cl. ..... 343/815; 343/818; 343/890

[58] Field of Search ..... 343/810, 812, 343/815, 818, 833, 819, 890, 778, 793

[56] References Cited

U.S. PATENT DOCUMENTS

| | | | |
|---|---|---|---|
| 2,688,083 | 8/1954 | Hills | 343/791 |
| 2,701,308 | 2/1955 | Kay | 343/808 |
| 2,772,413 | 11/1956 | Guernsey et al. | 343/808 |
| 2,980,912 | 4/1961 | Anderson | 343/815 |
| 3,392,399 | 7/1968 | Winegard | 343/815 |
| 3,475,759 | 10/1969 | Winegard | 343/815 |
| 3,683,391 | 8/1972 | Callaghan | 343/815 |
| 4,398,201 | 8/1983 | Winegard et al. | 343/815 |

*Primary Examiner*—Hoanganh T. Le
*Assistant Examiner*—Tan Ho
*Attorney, Agent, or Firm*—Harry M. Weiss; Jeffrey D. Moy; Harry M. Weiss & Associates, P.C.

[57] ABSTRACT

The present invention is an improved Yagi-Uda style antenna. Primarily, the present invention provides that at least two driven elements are spaced approximately 0.1 λ apart from each other. The driven elements are forced into a critical couple mode by electrically connecting the two driven elements with a matched phasing delay line. The phasing delay line retards the phase current sufficiently to, coupled with the specified element separation, satisfy both the endfire condition and the Hansen-Woodyard condition. This provides for increased directivity and gain, and deep nulls in the field strength. The at least two critically coupled elements compromise at least a first driven element, which is the primary broadcast element, and a second driven element, which is a driven reflector element. The reflector element acts to augment field strength in a direction toward the first driven element and reduce field strength in a direction away from the first driven element. The present invention may include the use of at least one parasitic director elements. These are elements that are not electrically coupled to the driven elements, but are inductively coupled. The present invention further provides an antenna with a greatly reduced loss resistance component. The present invention reduces nonradiative resistance losses with an element mounting saddle that incorporates an enlarged conductive contact surface area. This enlarged conductive contact surface area is designed to conform with the surface of the radiative element to be mounted on the saddle. By increasing the conductive contact surface area, current density at any one point in the contact is reduced. This allows larger currents to flow through the contact area with less resistance heating.

3 Claims, 6 Drawing Sheets

CRITICALLY COUPLED BI-PERIODIC DRIVER ANTENNA

FIELD OF THE INVENTION

The present invention relates to the antenna art, and has particular reference to a novel construction for an Yagi-Uda style critically coupled antenna.

BACKGROUND

This invention relates in general to antennas. More specifically to critically-coupled, bi-periodic driver, end-fire, surface-wave antennas tuned to a single frequency.

Antennas, metallic devices for radiating or receiving radio waves, can be designed in many ways. Array antennas are typically used when high directivity and front-to-back gain are desired. The transmission/reception characteristics of array antennas vary with antenna design, such as element placement, current amplitude and phase conditions. When the current phasing difference, $\alpha$, of a linear array of center fed elements is 0° or 180°, the antenna is termed a broad side antenna, or the field strength is at a maximum in a direction normal to a line containing the array of elements. When the current phasing difference between elements is 90° or 270°, the antenna is termed an endfire antenna with a field strength maximum directed along the line containing the radiative elements.

The prior art teaches that the optimum endfire antenna has a spacing, "d," between elements that satisfies the condition $\alpha=2\pi d/\lambda$ radians, where $\lambda$ is the working radio frequency wavelength of the antenna. This equation does not guarantee maximum possible directivity or the narrowest possible beam. For this the antenna design must also satisfy the Hansen-Woodyard condition, $\alpha=(2\pi d/\lambda+\pi/n)$, where n is the number of elements in the array. For an ideal isotropic point element, these conditions are simultaneously satisfied when $\alpha=135$, and $d=\lambda/8$.

One of the most common designs for end-fire antenna arrays is the Yagi-Uda design. A simple Yagi-Uda design antenna has a single driven element, at least one reflector element, and several director elements. Yagi-Uda antennas are enormously directional and typically have high gain in the receiving direction.

In Yagi-Uda antennas, the reflector and director elements are parasitic elements, that is, they do not have drive currents, but have induced currents produced by magnetic coupling with the driven element. Reflective parasitic elements typically have a length slightly longer than ½ of the working wavelength of the antenna and tend to reinforce the field strength in the direction of the driven element. Directive parasitic elements have lengths typically less than ½ of the working wavelength of the antenna and reinforce the field strength in the direction away from the driven element.

In Yagi-Uda design antenna arrays, the spacing between elements is important. A significant amount of the current flowing in each element is due to magnetic coupling of neighboring elements. A large spacing between elements results in a smaller the magnetic coupling. Additionally, the directivity of the field is dependent upon element spacing.

Inductive coupling is a factor that is important in antenna design. This is because an electrical current in a conductor generates a magnetic field. If this magnetic field interacts with a second conductor, an induced electrical current is produced in the second conductor. Take for example an electrically driven antenna element. The electrical current in the driven element generates a magnetic field that radiates from the driven element. When this magnetic field interacts with a nearby parasitic or non-driven element, the magnetic field induces an electrical current in the parasitic element. It is important to note that the induced electrical current in the parasitic element also generates a magnetic field that can interact with the original driven element creating an induced current component in the driven element. These perturbations continue until a state of equilibrium is reached. The induced current perturbations can get extremely complex as more elements, driven or parasitic, are added to the antenna array. In the special case where the currents flowing in a pair of magnetically coupled elements are equal, the elements are considered to be "critically coupled".

Critically coupled antennas are useful since these antennas have a theoretically infinite front-to-back ratio, a 'guaranteed' forward gain of 5.3 dBd, and the ability to 'steer' the direction of the deep nulls at the rear of the antennas, thus reducing interference and noise. Mutually induced induction is not the only way to critically couple two elements. One alternative method to critically couple two driven elements is to electrically connect the two elements together with a variable capacitor. Careful, tuning of the variable capacitor will yield the critical coupling condition. This is called "capacitive coupling." Another alternative method is to drive both elements from the same voltage source. This is called "driven coupling".

The power of an antenna relates to the current supplied to the antenna by the well known law: $P=I^2R$, where P is the power supplied to the antenna and R is the total resistance of the antenna. The total resistance, R, is a combination of radiative resistances, $R_{radiative}$, and loss resistances, $R_{loss}$. Radiative resistances, which are important for antenna performance, are equated to the power lost from the actual broadcast of radio waves. Loss resistances, which generally degrade antenna performance, result from resistance heating of portions of the antenna. Antenna features that increase radiative resistances and decrease loss resistances boost antenna performance and are sought after by antenna designers.

An example of dual driven coupling antenna in the prior art are the famous "ZL Special" and W8JK antennas. These antennas contain a pair of element driven from the same current source. Unfortunately, they do not perform up to the expectations for an actual critically coupled antenna. The ZL-Special, W8JK and a number of other antennas rely upon unmatched phasing lines. This results in a dual driven antenna that does not have the requisite current and phasing for the two elements to be critically coupled. The mismatch in current phasing resulting from the unmatched feeding or phasing lines means little if any coupling current flows, and therefore all of the advantages of critical coupling are absent.

Phil Harman, VK6APH/G3WXO, has created a dual-driven critically coupled array that utilizes two feed lines that are approximately the same length. The phasing and current amplitude of the two feed lines are adjusted by overlapping and/or twisting the feed lines near the voltage source in order to create the requisite current at the elements necessary for critical coupling.

SUMMARY OF THE INVENTION

It is an object of the present invention to provide an improved Yagi-Uda style antenna. Primarily, the present invention provides at least two driven elements spaced approximately 0.1 $\lambda$ apart from each other. This spacing, which the prior art teaches against, is critical for the present invention. The driven elements are forced into a critical couple mode by electrically connecting the two driven elements with a matched phasing delay line. The phasing delay line retards the phase current sufficiently to, coupled with the specified element separation, satisfy both the end-fire condition and the Hansen-Woodyard condition. This provides for increased directivity and gain, and deep nulls in the field strength.

It is a further object of the present invention for the two critically coupled elements to compromise a first driven element, which is the primary broadcast element, and a second driven element, which is a driven reflector element. The reflector element acts to augment field strength in a direction toward the first driven element and reduce field strength in a direction away from the first driven element.

It is another object of the present invention to provide additional antenna designs which, using the above discussed element spacing, include the use of at least one parasitic director elements. These are elements which are not electrically coupled to the driven elements, but are inductively coupled. Director elements act to increase the field strength in a direction away from the first driven element.

It is yet another object of the present invention to provide an antenna with a greatly reduced loss resistance component. The present invention reduces non-radiative resistance losses with an element mounting saddle that incorporates an enlarged conductive contact surface area. This enlarged conductive contact surface area is designed to conform with the surface of the radiative element to be mounted on the saddle. By increasing the conductive contact surface area, current density at any one point in the contact is reduced. This allows larger currents to flow through the contact area with less resistance heating.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1:
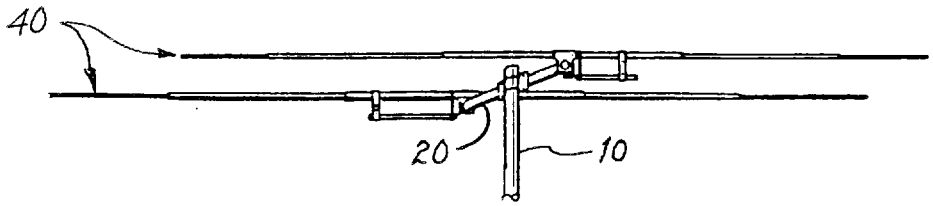
FIG. 1 is a perspective view of the first preferred embodiment.
Figure 2:
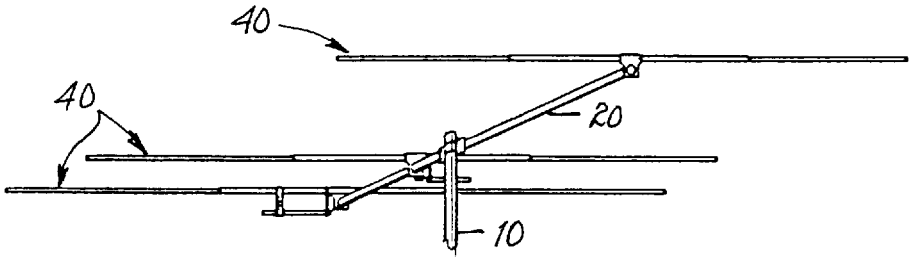
FIG. 2 is a perspective view of the second preferred embodiment.
Figure 3:
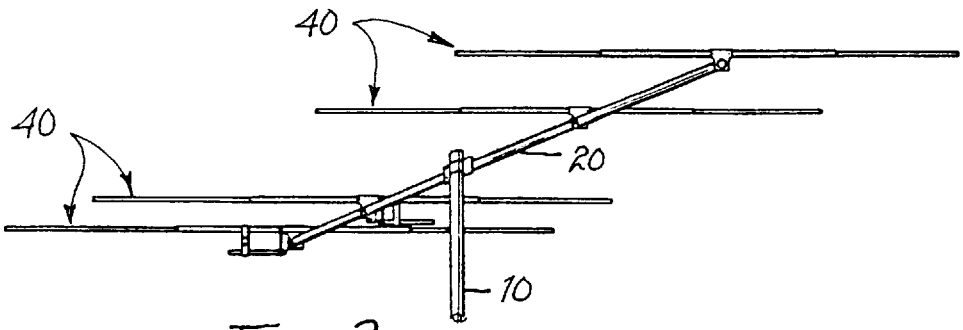
FIG. 3 is a perspective view of the third preferred embodiment.
Figure 4:
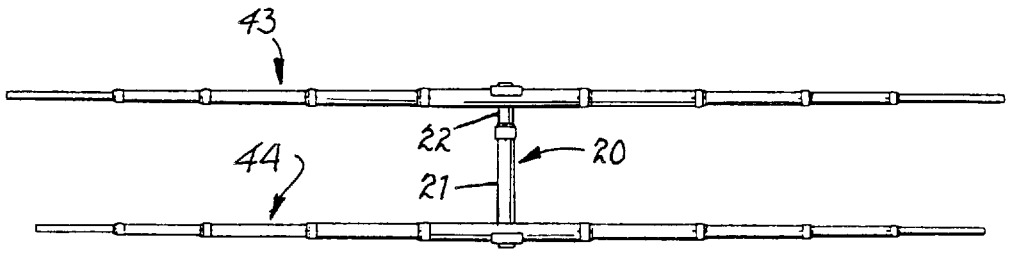
FIG. 4 is a top view of the first preferred embodiment.
Figure 5:
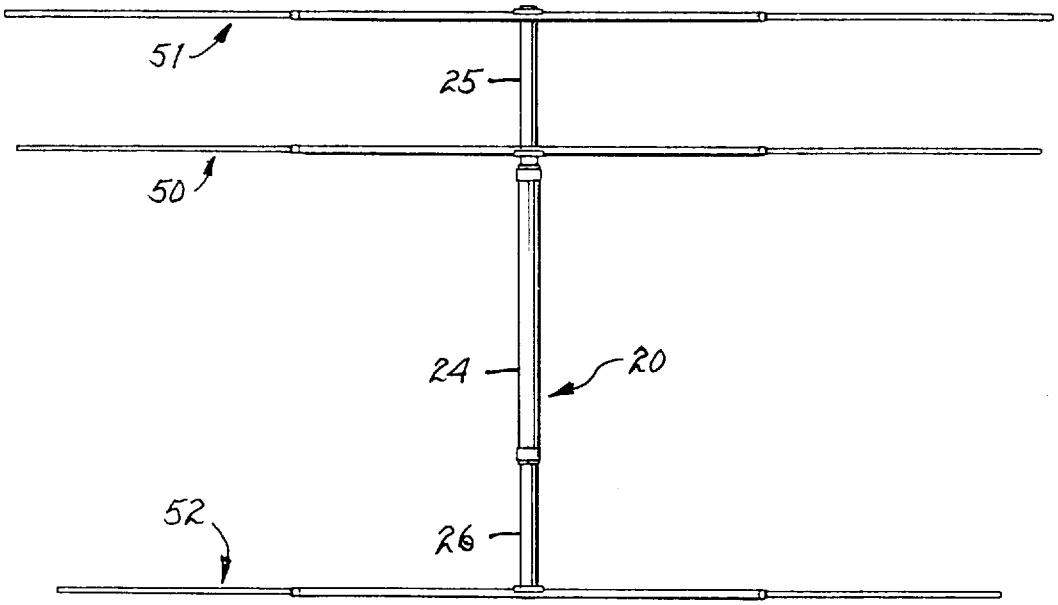
FIG. 5 is a top view of the second preferred embodiment.
Figure 6:
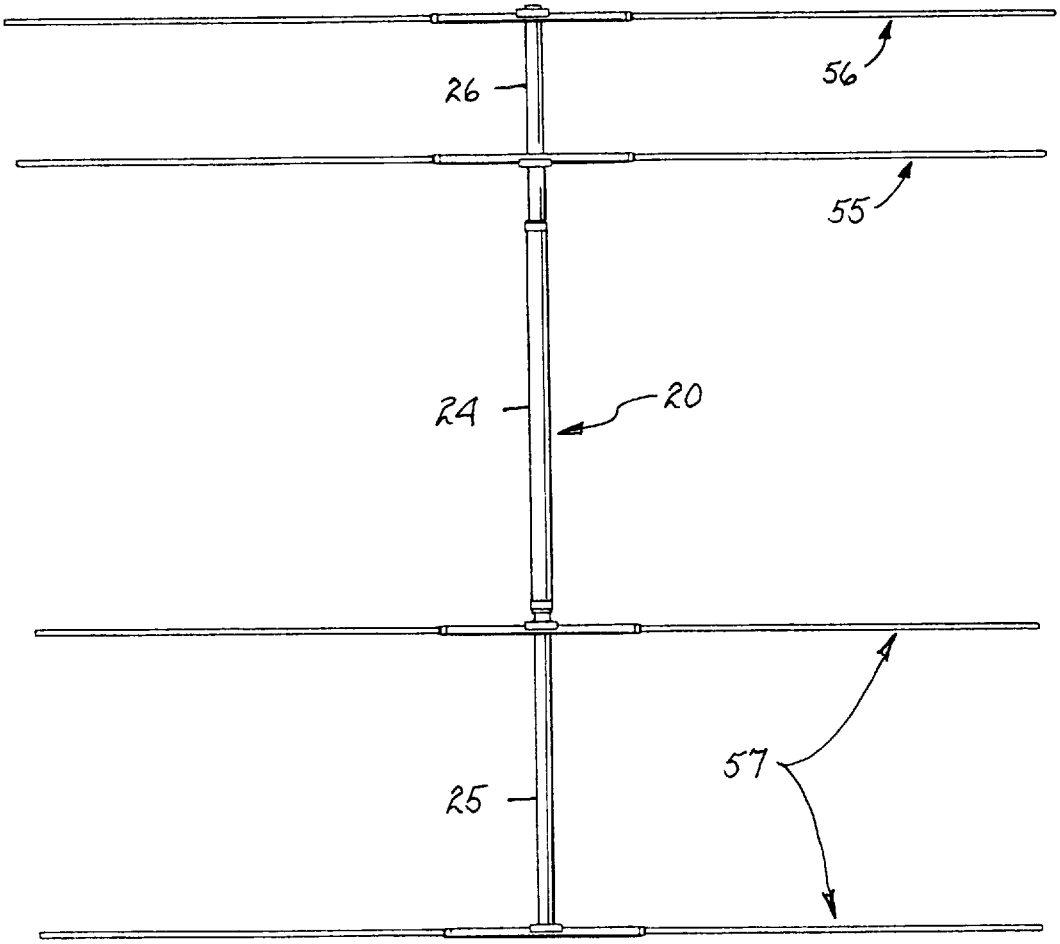
FIG. 6 is a top view of the third preferred embodiment.
Figure 7:
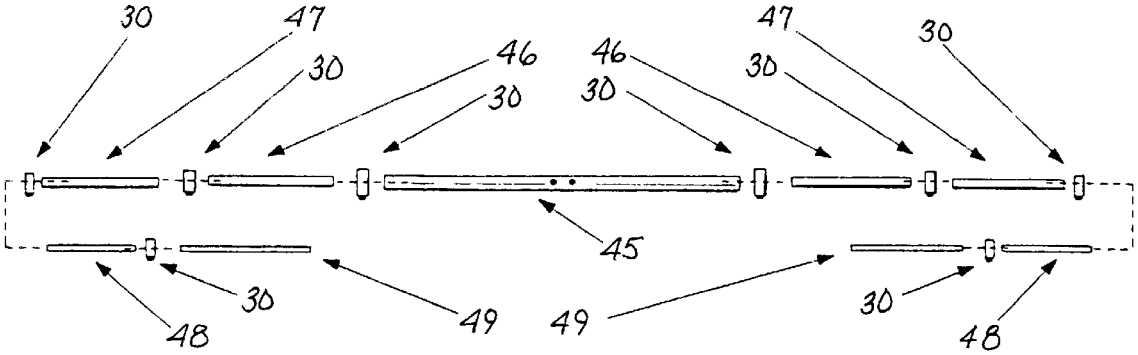
FIG. 7 is an exploded view of an element assembly of the first preferred embodiment.
Figure 8:
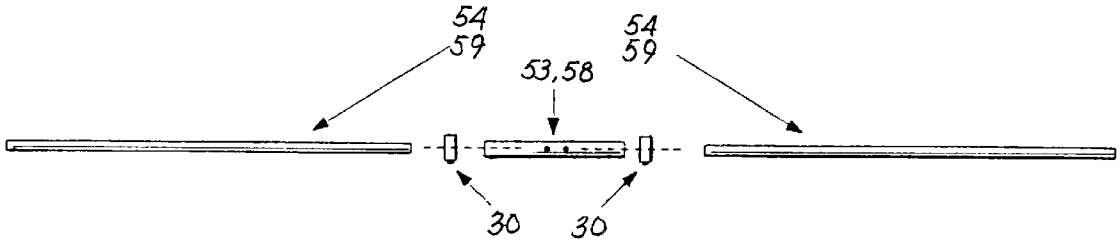
FIG. 8 is an exploded view of an element assembly of the second and third preferred embodiment.
Figure 9:
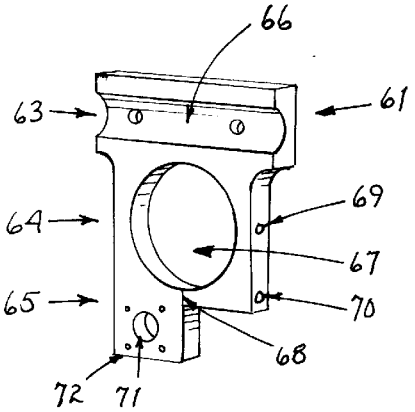
FIG. 9 is a view of a first driven element saddle mounting bracket.
Figure 10:
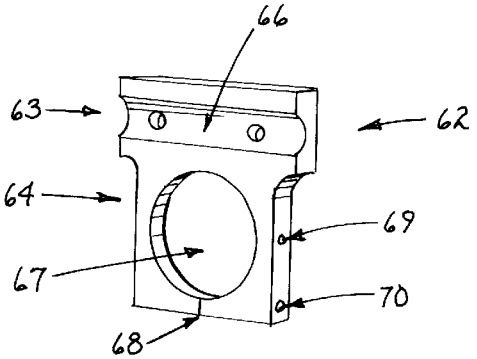
FIG. 10 is a view of a second driven element saddle mounting bracket.
Figure 11:
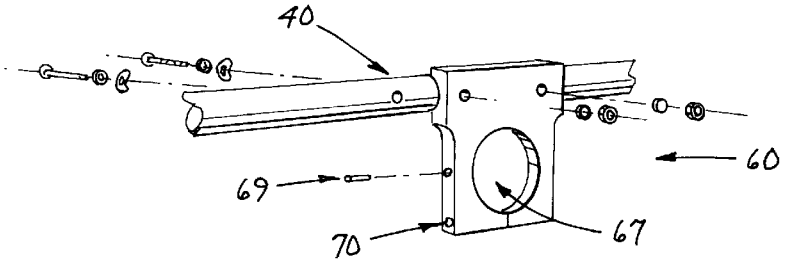
FIG. 11 is an exploded view illustrating the method of mounting elements onto saddle mounting brackets.
Figure 16:
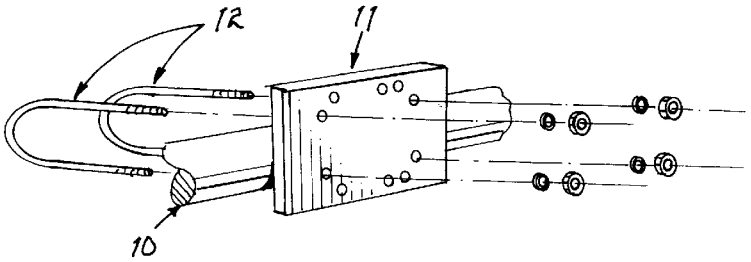
FIG. 16 shows the details of the boom-to-mast mounting bracket.
Figure 17:
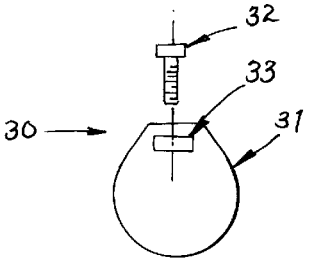
FIG. 17 depicts a typical tubing clamp assembly of the present invention.
Figure 12:
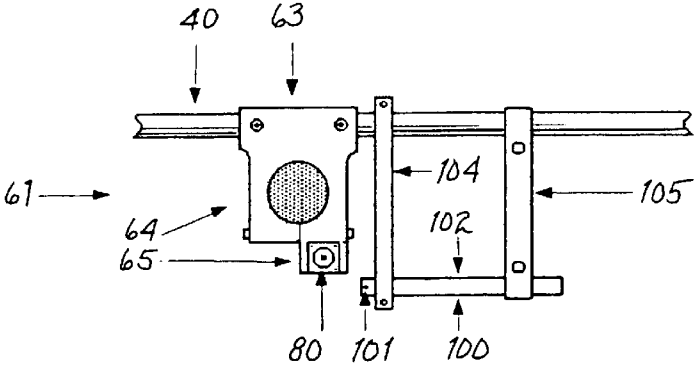
FIG. 12 is a view of the first driven element driver mounted in relationship with the first driven element saddle mounting bracket.
Figure 13:
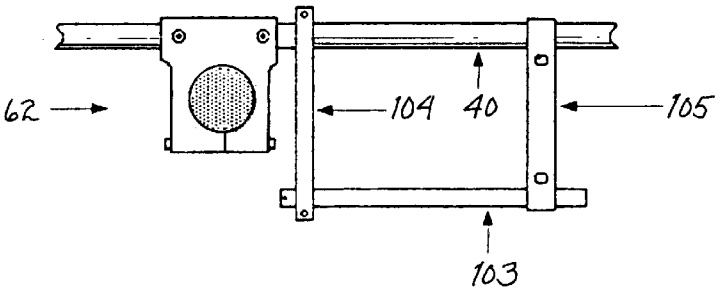
FIG. 13 is a view of the second driven element driver mounted in relationship with the second driven element saddle mounting bracket.
Figure 14:
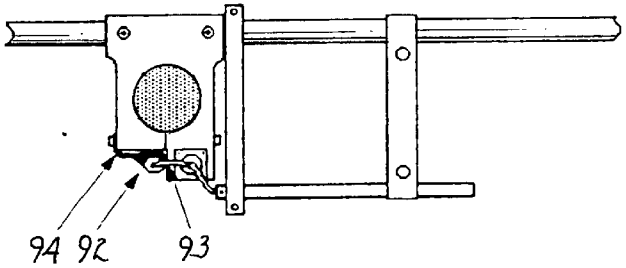
FIG. 14 shows the electrical connection of the phasing delay line with the first driven element saddle mounting bracket and driver.
Figure 15:
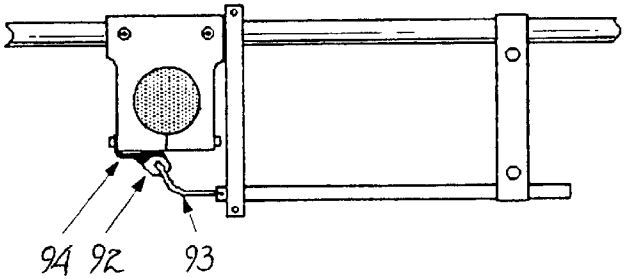
FIG. 15 shows the electrical connections of the phasing delay line with the second driven element saddle mounting bracket and driver.

There are described below several preferred embodiments of the present invention. Many of the features of the different embodiments are fabricated in a similar manner. Where there are variances in the construction of the various embodiments, these variations will be discussed together in the same section.

All of the antenna embodiments primarily comprise a mast 10, a boom assembly 20 attached to the mast, and a set of radiative element assemblies 40 attached to the boom assembly 20. A first preferred embodiment 1 of the present invention is an antenna with two element assemblies 40, both of which are driven element assemblies 41. A second preferred embodiment 2 of the present invention is an antenna with three element assemblies 40, two of which are driven element assemblies 41 and the third a parasitic director element assembly 42. And, a third preferred embodiment 3 of the present invention is an antenna with four element assemblies, two of which are driven element assemblies 41 and the remaining two are parasitic director element assemblies 42.

The boom assemblies 20 of the three embodiments may be constructed from at least one tubing section and can be either conducting or non-conducting. Preferably the boom assemblies are constructed from multiple sections for shipping and handling purposes.

In the first preferred embodiment 1, the boom assembly 20 comprises a first tubing section 21 and a second tubing section 22. The first tubing section 21 has an interior diameter large enough to receive the second tubing section 22 in a telescopic fashion. The two tubing sections are held together using a boom tubing clamp assembly 30 which prevents rotational and longitudinal motions of the first tubing section 21 relative to the tubing second section 22. The tubing clamp assembly 30 is simply comprised of a compression band 31 which encircles the tubing, a pressure bolt 32 received by the pressure band and an attached nut 33. Preferably, the first tubing section 21 is 6'×1.5", while the second tubing section 22 is 18"×1.375". The overall length of the boom assembly 20 of the first preferred embodiment 1 should be approximately 7' 1⅜".

In the second and third preferred embodiments, the boom assembly 20 comprises a first section tubing 24, a second section tubing 25 and a third tubing section 26. The first tubing section 24 has an interior diameter large enough to receive the second and third tubing sections 25, 26 in a telescopic fashion at opposite ends of the first tubing section 24. The second and third tubing sections 25, 26 are relationally secured to the first tubing section 24 by two boom tubing clamp assemblies 30. Preferably, in the second embodiment 2, the first tubing section 24 is 1⅜"×5, the second tubing section 25 is 1¼"×4' 5", and the third tubing section 26 is 1¼"×4' 5". The overall length of the boom assembly 20 of the second preferred embodiment 2 should be approximately 12' 9". Preferably, in the third embodiment 3, the first tubing section 24 is 1.25"×3' 6 ½", the second tubing section 25 is 1.375"×6', and the third tubing section 26 is 1.25"×5' 3½". The overall length of the boom assembly 20 of the third preferred embodiment 3 should be approximately 13' 9".

In the preferred embodiments, the first parasitic elements are located between 0.25 and 0.33 of the operating wavelength from the first driven element and any additional parasitic elements are located between 0.25 and 0.22 of the operating wavelength from the other parasitic elements.

The element assemblies 40 are preferably bilaterally symmetric and are fabricated from a plurality of telescoping conductive sections. Generally, the first driven element assemblies are approximately ½ λ long, or their lengths are half of the operating frequency wavelength, second driven element assemblies are slightly longer, and parasitic director element assemblies are slightly shorter.

In the first preferred embodiment 1 there are two driven element assemblies 41, a first driven element assembly 43 and a second driven element assembly 44. Each driven element assembly 41 comprises five distinct conductive sections: a central conductive section 45, 1"×6'; a second conductive section 46, ⅞"×4'; a third conductive section 47, ¾"×4"; a forth conductive section 48, ⅝"×3'; and a fifth conductive section 49, ½"4' for the first driven element assembly 43; and ½"×5' for the second driven element assembly 44. The central conductive section 45 is a tubing having an inner diameter large enough to receive the second conductive section 46. The second conductive section 46 is secured to the central conductive section 45 by tubing clamp assemblies 30 and has 3' 9" of exposed surface. The second conductive section 46 is a tubing having an inner diameter large enough to receive the third conductive section 47. The third conductive section 47 is secured to the second conductive section 46 by tubing clamp assemblies 30 and has 3' 9" of exposed surface. The third conductive section 47 is a tubing having an inner diameter large enough to receive the fourth conductive section 48. The fourth conductive section 48 is secured to the third conductive section 47 by tubing clamp assemblies 30 and has 2' 6⅞" of exposed surface for the first driven element assembly 43 and 2' 9" of exposed surface for the second driven element assembly 44. The fourth conductive section 48 is a tubing having an inner diameter large enough to receive the fifth conductive section 49. The fifth conductive section 49 is secured to the fourth conductive section 48 by tubing clamp assemblies 30 and has 3' 6 11/16" of exposed surface for the first driven element assembly 43 and 4' 5 7/16" of exposed surface for the second driven element assembly 44. This should result in a first driven element assembly 43 of the first preferred embodiment 1 with an overall length of approximately 33' 3⅛", and a second driven element assembly 44 of the first preferred embodiment 1 with an overall length of approximately 35' 4⅞".

In the second preferred embodiment 2 there are three element assemblies 40: a first driven element assembly 50, a second driven element assembly 51 and a parasitic element assembly 52. Each element assembly 40 of the second preferred embodiment 2 has two distinct conductive sections: a central conductive section 53, ⅝"×6'; and a second conductive section 54, ½"×6'. The central conductive section 53 is a tubing having an inner diameter large enough to receive the second conductive section 54. The second conductive section 54 is secured to the central conductive section 53 by tubing clamp assemblies 30 and has the following exposed surface lengths: 5' 3" for the first driven element assembly 50; 5' 7½" for the second driven element assembly 51; and 4' 8¾" for the parasitic element assembly 52.

In the third preferred embodiment 3, there are four element assemblies 40: a first driven element assembly 55, a second driven element assembly 56 and two parasitic element assemblies 57. Each element assembly 40 of the third preferred embodiment 3 has two distinct conductive sections: a central conductive section 58, ¾"×2'; and a second conductive section 59, ⅝"×6'. The central conductive section 58 is a tubing having an inner diameter large enough to receive the second conductive section 59. The second conductive section 59 is secured to the central conductive section 58 by tubing clamp assemblies 30 and has the following exposed surface lengths: 3' 7¼" for the first driven element assembly 55; 3' 9⅜" for the second driven element assembly 56; and 3' 5⅞" for the two parasitic element assemblies 57.

All element assemblies are attached to the boom assembly 20 with element bracket saddles 60. There are two types of element bracket saddles 60: a first driven element bracket saddle 61, which is used to attach first driven element assemblies to their boom assemblies; and, a second driven element bracket saddle 62, which is used to attach second driven element assemblies and parasitic element assemblies to their boom assembly.

Traditional antennas utilize simple structures which provide only a minimum of surface contact area for electrical connections. In the present invention, the element bracket saddles 60 act both as mounting brackets for the element assemblies 40 and a conductive interface between the element assemblies 40 and a radio frequency transmitter/receiver 90 of the antenna's electrical circuit. The element bracket saddles 60 of the present invention are comprised of: an element attachment portion 63; a boom mounting portion 64 attached to the element attachment portion 63; and, in the case of the first element bracket saddle 61, a RF connector attachment portion 65 connected to the boom mounting portion 64. The element attachment portion 63 contains an enlarged conductive contact surface 66 which is a cylindrically concave area designed to conform to the outer surface of the central sections of the element assemblies 40. The enlarged conductive contact surface 66 provides a larger conduction contact surface area resulting in a lower current density at the contact point and an effective lowering of resistive losses attributable to the conduction point contact. The boom mounting portion 64 has a boom mounting aperture 67 sized to receive the boom assemblies 40. The boom mounting portion 64 may also contain a size adjustment slit 68 extending from the boom mounting aperture 67 to an outside surface which provides for radial adjustment of the size of the boom mounting aperture 67 necessary to insure a secure fit. There may also be provided a set screw 69 to prevent rotation of the element mounting saddles 60 relative to the boom assembly 40, and a boom mounting tightening aperture and screw 70 for compressing the diameter of the boom mounting aperture 67 and clamping the element mounting saddles 60 onto the boom assemblies 40. In the special case of first driven element mounting saddles in all preferred embodiments, there is a final portion, the RF connector attachment portion 65. The RF connector attachment portion 65 has an aperture 71 for receiving a RF connector 80, and at least two RF connector attachment apertures 72 for receiving screws necessary to secure the RF connector 80 to the RF connector attachment portion 65.

The central sections of the element assemblies 40 are mounted to the element mounting saddles 60, preferably with a conductive paste interposed between the central sections and the element mounting saddles. The element mounting saddles 60 are then attached to the boom assembly 20 by inserting the boom assembly 20 into the boom mounting apertures 67 provided in the element mounting saddles 60, making sure that the driven elements 41 face inward or toward the center of gravity of the entire assembly. The boom mounting tightening screws 70 are tightened, thereby clamping the element mounting saddles 60 onto the boom assembly 20, and the set screws 69 are engaged, thereby preventing rotational movement of the element mounting saddles 60 relative to the boom assembly 20.

In all embodiments, both first and second driven element assemblies have element drivers, each with matching arms 100 which an electrical connection aperture 101 located at one end, attached to one side of the element assembly. The matching arm 103 of the element driver on the second driven element assembly should be mounted on a side opposite of the side onto which the matching arm 102 of the element driver of the first driven element assembly is mounted. Insert one end of a stand-off insulator 104 onto a driven element assembly 41. Insert the ends of the matching arms 100 with the electrical connection apertures 101 into stand-off insulators 104 at a second end of the stand-off insulators 104 and align the electrical connection apertures 101 horizontally. Position the stand-off insulators 104 ⅜" from an edge of the element mounting saddles 60, aligning each stand-off insulator 104 vertically. Apply some conductive contact compound to the inside of both loops of a shorting strap 105 and install a first shorting strap loop over the ends of the driven element central sections and a second shorting strap loop over the matching arms. Position the shorting straps 105 and align the matching arms 100 to the following dimensions: for the first preferred embodiment 1, the end of the matching arms 100 with the electrical connection apertures 101 should extend inward from the stand-off insulators 104 approximately 7/16", the shorting strap 105 of the first driven element 43 should be located approximately 15⅜" from the inside edge of the stand-off insulator 104, and the shorting strap 105 of the second driven element 44 should be located approximately 28¾" from the inside edge of the stand-off insulator 104; for the second preferred embodiment 2, the end of the matching arms 100 with the electrical connection apertures 101 should extend inward from the stand-off insulators 104 approximately 7/16", the shorting strap 105 of the first driven element 50 should be located approximately 5⅜" from the inside edge of the stand-off insulator 104, and the shorting strap 105 of the second driven element 51 should be located approximately 9¾" from the inside edge of the stand-off insulator 104; for the third preferred embodiment 3, the end of the matching arms 100 with the electrical connection apertures 101 should extend inward from the stand-off insulator 104 approximately ½", the shorting strap 105 of the first driven element 55 should be located approximately 2 3/16" from the inside edge of the stand-off insulator 104, and the shorting strap 105 of the second driven element 56 should be located approximately 5¼" from the inside edge of the stand-off insulator 104.

In all embodiments, the RF connector 80 is placed within the RF connector receiving aperture 71 of the first driven element mounting saddles 61. Mounting apertures 81 included in the RF connector 80 are aligned with the RF connector mounting apertures 72 located on the RF connector attachment portion 65.

The mast 10 is typically mounted into the Earth, or mounted onto a house. The boom assembly 20 is mounted at a top end of the mast. In the present invention the boom assembly is mounted to the mast with a boom-to-mast mounting plate 11, a first pair of U-bolts 12, and a second pair of U-bolts 13. The mast 10 is mounted to a first face 14 of the boom-to-mast mounting plate 11 by placing the mast 10 inside of the first pair of U-bolts 12 and fixing the boom-to-mast mounting plate 11 to the first pair of U-bolts 12 with nuts and washers. The boom assembly 20 is then mounted to a second face 15 of the boom-to-mast mounting plate 11 in a like fashion, using the second pair of U-bolts 13, but rotated 90° relative to the mast.

The radio frequency receiver/transmitter 90 is electrically attached to the RF connector 80 by a coaxial cable 91. The RF connector 80 is electrically connected to the first and second driven element assemblies by a matched phasing delay line 92 with a length approximately equal to the separation distance between driven element assemblies. The phasing delay line not only electrically couples the driven element assemblies, but retards the phase of the current transmitted therein. For a two element antenna it is critical that the phasing delay line have a velocity factor of 0.66. For the three and four element antennas it is critical that the phasing delay line have a velocity factor of 0.76. A center conductor 93 of the phasing delay line 92 is attached at one end to a center post 85 of the RF connector 80 and is jumpered to the matching arm on the first driven element assembly. The center conductor 93 of the phasing delay line 92 is attached at an opposite end to the matching arm of the second driven assembly. A second conductor 94 of the phasing delay line 92 is attached at one end to the first driven element mounting saddle 61 and attached at an opposite end to the second driven element mounting saddle 62.

While these descriptions are directed to embodiments operating at 14–14.35 MHz, 28.1–28.7 MHz, and 50–50.3 MHz, it is understood that those skilled in the art may conceive modifications and/or variations to the specific embodiments shown and described herein, particularly modifications in operational frequencies. Any such modifications or variations which fall within the purview of this description are intended to be included therein as well. It is understood that the description herein in intended to be illustrative only and is not intended to be limitative. Rather, the scope of the invention described herein is limited only by the claims appended hereto.

What is claimed is:

1. An antenna comprising:

i) a mast;

ii) a boom assembly;

iii) a boom-to-mast mounting bracket for attaching the boom assembly to the mast;

iv) first and second driven element assemblies, said first driven element assembly having a length approximately one half of the operating frequency wavelength of the antenna, and said second driven element assembly having a length greater than one half of the operating frequency wavelength of the antenna and the distance between the first and second driven element assemblies is approximately 0.1 of the operating frequency wavelength of the antenna;

v) two element drivers, one for each element assembly, for electrically driving the element assembly, said element driver having a matching arm with an aperture at a first end, a stand-off insulator attached at one end to the element assembly and at an opposite end to the first end of the matching arm, and a shorting strap attached at one end to the element assembly and at an opposite end to a second end of the matching arm;

vi) first and second driven element saddle brackets, the first and second driven element saddle brackets attaching the first and second driven element assemblies to the boom assembly respectively, wherein the first driven element saddle bracket has an element attachment portion with an enlarged contact surface area contoured to closely fit the first element assembly, a boom mounting portion attached to the element attachment portion, and a RP connector attachment portion connected to the boom mounting portion, the second driven element saddle bracket has an element attachment portion with an enlarged contact surface area contoured to closely fit the second element assembly, and a boom mounting portion attached to the element attachment portion; and vii) an electrical circuit comprising a radio frequency transmitter/receiver, a coaxial cable connected at one end to the radio frequency transmitter/receiver and connected at an opposite end to the RF connector which is attached to the RF connector attachment portion of the first driven element saddle bracket, a 0.66 velocity factor phasing delay line with at least a first conductor and a second conductor, said first conductor attached at one end to a center post on the RF connector and jumpered to the element driver on the first drive n element assembly and attached at an opposite end to the element driver on the second driven element assembly, and said second conductor attached at one end to a first driven element saddle bracket and attached at an opposite end to a second driven element saddle bracket.

2. An antenna comprising:

i) a mast;

ii) a boom assembly;

iii) a boom-to-mast mounting bracket for attaching the boom assembly to the mast;

iv) first and second driven element assemblies, said first driven element assembly having a length approximately one half of the operating frequency wavelength of the antenna, and said second driven element assembly having a length greater than one half of the operating frequency wavelength of the antenna and the distance between the first and second driven element assemblies is approximately 0.1 of the operating frequency wavelength of the antenna;

v) a parasitic director element assembly having a length less that one half of the operating frequency wavelength of the antenna, and being separated from the first driven element assembly by between 0.25 and 0.33 of the operating frequency wavelength of the antenna;

vi) two element drivers, one for each driven element assembly, for electrically driving the element assembly, said element driver having a matching arm with an aperture at a first end, a stand-off insulator attached at one end to the element assembly and at an opposite end to the first end of the matching arm, and a shorting strap attached at one end to the element assembly and at an opposite end to a second end of the matching arm;

vii) first and two second driven element saddle brackets, the first driven element saddle bracket attaching the first driven element assembly to the boom assembly and two second driven element saddle brackets attaching the second driven element assembly and parasitic element assembly to the boom assembly, wherein the first driven element saddle bracket has an element attachment portion with an enlarged contact surface area contoured to closely fit the first element assembly, a boom mounting portion attached to the element attachment portion, and a RF connector attachment portion connected to the boom mounting portion, the second driven element saddle bracket has an element attachment portion with an enlarged contact surface area contoured to closely fit the second element assembly, and a boom mounting portion attached to the element attachment portion; and viii) an electrical circuit comprising a radio frequency transmitter/receiver, a coaxial cable connected at one end to the radio frequency transmitter/receiver and connected at an opposite end to the RF connector which is attached to the RF connector attachment portion of the first driven element saddle bracket, a 0.76 velocity factor phasing delay line with at least a first conductor and a second conductor, said first conductor attached at one end to a center post on the RF connector and jumpered to the element driver on the first driven element assembly and attached at an opposite end to the element driver on the second driven element assembly, and said second conductor attached at one end to a first driven element saddle bracket and attached at an opposite end to a second driven element saddle bracket.

3. An antenna comprising:

i) a mast;

ii) a boom assembly;

iii) a boom-to-mast mounting bracket for attaching the boom assembly to the mast;

iv) first and second driven element assemblies, said first driven element assembly having a length approximately one half of the operating frequency wavelength of the antenna, and said second driven element assembly having a length greater than one half of the operating frequency wavelength of the antenna and the distance between the first and second driven element assemblies is approximately 0.1 of the operating frequency wavelength of the antenna;

v) two parasitic director element assemblies, each having a length less that one half of the operating frequency wavelength of the antenna, and a first parasitic element assembly being separated from the first driven element assembly by between 0.25 and 0.33 of the operating frequency wavelength of the antenna and a second parasitic element assembly being separated from the first parasitic element assembly by between 0.25 and 0.33 of the operating frequency wavelength of the antenna;

vi) two element drivers, one for each driven element assembly, for electrically driving the element assembly, said element driver having a matching arm with an aperture at a first end, a stand-off insulator attached at one end to the element assembly and at an opposite end to the first end of the matching arm, and a shorting strap attached at one end to the element assembly and at an opposite end to a second end of the matching arm;

vii) first and three second driven element saddle brackets, the first driven element saddle bracket attaching the first driven element assembly to the boom assembly and the three second driven element saddle brackets attaching the second driven element assembly and two parasitic element assembly to the boom assembly, wherein the first driven element saddle bracket has an element attachment portion with an enlarged contact surface area contoured to closely fit the first element assembly, a boom mounting portion attached to the element attachment portion, and a RF connector attachment portion connected to the boom mounting portion, the second driven element saddle bracket has an element attachment portion with an enlarged contact surface area contoured to closely fit the second element assembly, and a boom mounting portion attached to the element attachment portion; and viii) an electrical circuit comprising a radio frequency transmitter/receiver, a coaxial cable connected at one end to the radio frequency transmitter/receiver and connected at an opposite end to the RF connector which is attached to the RF connector attachment portion of the first driven element saddle bracket, a 0.76 velocity factor phasing delay line with at least a first conductor and a second conductor, said first conductor attached at one end to a center post on the RF connector and jumpered to the element driver on the first driven element assembly and attached at an opposite end to the element driver on the second driven element assembly, and said second conductor attached at one end to a first driven element saddle bracket and attached at an opposite end to a second driven element saddle bracket.

* * * * *